US007924242B2

(12) United States Patent
Yoon

(10) Patent No.: US 7,924,242 B2
(45) Date of Patent: Apr. 12, 2011

(54) APPARATUS AND METHOD OF DRIVING PLASMA DISPLAY PANEL

(75) Inventor: Sang-Jin Yoon, Gyeongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/565,387

(22) PCT Filed: Jul. 23, 2004

(86) PCT No.: PCT/KR2004/001865
§ 371 (c)(1),
(2), (4) Date: Jan. 29, 2007

(87) PCT Pub. No.: WO2005/010856
PCT Pub. Date: Feb. 3, 2005

(65) Prior Publication Data

US 2007/0139360 A1 Jun. 21, 2007

(30) Foreign Application Priority Data

Jul. 24, 2003 (KR) ..... 10-2003-0050890

(51) Int. Cl.
*G09G 3/28* (2006.01)

(52) U.S. Cl. ..... 345/68; 345/60

(58) Field of Classification Search ..... 345/60–72; 315/169.4
See application file for complete search history.

(56) References Cited

U.S. PATENT DOCUMENTS 6,034,482 A 3/2000 Kanazawa et al.
6,249,087 B1 * 6/2001 Takayama et al. ..... 315/169.1
6,256,001 B1 7/2001 Kim et al.
6,288,692 B1 9/2001 Kanazawa et al.
6,294,875 B1 9/2001 Kurata et al.
6,528,952 B2 3/2003 Kato et al.
6,603,447 B1 8/2003 Ito et al.
6,628,087 B2 9/2003 Roh et al.
6,707,436 B2 3/2004 Setoguchi et al.
6,747,614 B2 * 6/2004 Takayama ..... 345/60
6,768,478 B1 * 7/2004 Wani et al. ..... 345/60
6,803,888 B1 10/2004 Nakamura et al.
6,862,009 B2 3/2005 Park
6,876,343 B2 4/2005 Myoung et al.
6,906,690 B2 6/2005 Lim
(Continued)

FOREIGN PATENT DOCUMENTS

CN 1313582 9/2001
(Continued)

OTHER PUBLICATIONS

Chinese Office Action dated Sep. 14, 1007.
(Continued)

*Primary Examiner* — Kevin M Nguyen
(74) *Attorney, Agent, or Firm* — KED & Associates LLP

(57) ABSTRACT

An apparatus and method of driving a plasma display panel for preventing a brightness spot miss-fire and a miss-writing as well as reducing a manufacturing cost are disclosed. In the apparatus, a set-up supplier supplies a rising ramp waveform to scan electrodes in an initialization period, and supplies a positive enhancing pulse to the scan electrodes during an enhancing period following said initialization period. A negative voltage supplier supplies a falling ramp waveform to the scan electrodes in the initialization period, and supplies a negative enhancing pulse to the scan electrodes during the enhancing period.

11 Claims, 9 Drawing Sheets

U.S. PATENT DOCUMENTS

| | | | | |
|---|---|---|---|---|
| 7,109,951 | B2 | 9/2006 | Kim et al. | |
| 7,218,292 | B2 | 5/2007 | Kashio et al. | |
| 2001/0017605 | A1* | 8/2001 | Hashimoto et al. | 345/60 |
| 2001/0033255 | A1 | 10/2001 | Otsuka et al. | |
| 2002/0012075 | A1 | 1/2002 | Nagakubo et al. | |
| 2002/0033675 | A1* | 3/2002 | Kang et al. | 315/169.1 |
| 2002/0063663 | A1* | 5/2002 | Homma | 345/60 |
| 2002/0075206 | A1* | 6/2002 | Takeda et al. | 345/60 |
| 2002/0195970 | A1 | 12/2002 | Lim et al. | |

FOREIGN PATENT DOCUMENTS

| | | | |
|---|---|---|---|
| EP | 1 172 794 | A2 | 1/2002 |
| JP | 11-265164 | | 9/1999 |
| JP | 2001-202060 | | 7/2001 |
| JP | 2001-272946 | | 10/2001 |
| JP | 2001-305447 | | 10/2001 |
| JP | 2002-351398 | | 12/2002 |
| WO | WO 03/015068 | | 2/2003 |

OTHER PUBLICATIONS

European Search Report dated Aug. 14, 2009.

Japanese Office Action dated Mar. 30, 2010.

* cited by examiner

SET-DOWN

APPARATUS AND METHOD OF DRIVING PLASMA DISPLAY PANEL

TECHNICAL FIELD

This invention relates to a plasma display panel, and more particularly to an apparatus and method for driving a plasma display panel that is adaptive for preventing a brightness spot miss-fire and a miss-writing as well as reducing a manufacturing cost.

BACKGROUND ART

Generally, a plasma display panel (PDP) excites and radiates a phosphorus material using an ultraviolet ray generated upon discharge of an inactive mixture gas such as He+Xe, Ne+Xe or He+Ne+Xe, to thereby display a picture. Such a PDP is easy to be made into a thin-film and large-dimension type. Moreover, the PDP provides a very improved picture quality owing to a recent technical development.

Referring to FIG. 1, a discharge cell of a conventional three-electrode, AC surface-discharge PDP includes a scan electrode 30Y and a sustain electrode 30Z provided on an upper substrate 10, and an address electrode 20X provided on a lower substrate 18.

Each of the scan electrode 30Y and the sustain electrode 30Z includes transparent electrodes 12Y and 12Z, and metal bus electrodes 13Y and 13Z having smaller line widths than the transparent electrodes 12Y and 12Z and provided at one edge of the transparent electrodes 12Y and 12Z. The transparent electrodes 12Y and 12Z are usually formed from indium-tin-oxide (ITO) on the upper substrate 10. The metal bus electrodes 13Y and 13Z are usually formed from a metal such as chrome (Cr), etc. on the transparent electrodes 12Y and 12Z to thereby reduce a voltage drop caused by the transparent electrodes 12Y and 12Z having a high resistance.

On the upper substrate 10 provided, in parallel, with the scan electrode 30Y and the sustain electrode 30Z, an upper dielectric layer 14 and a protective film 16 are disposed. Wall charges generated upon plasma discharge are accumulated onto the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with a phosphorous material layer 26. The address electrode 20X is formed in a direction crossing the scan electrode 30Y and the sustain electrode 30Z. The barrier rib 24 is formed in parallel to the address electrode 20X to thereby prevent an ultraviolet ray and a visible light generated by a discharge from being leaked to the adjacent discharge cells. The phosphorous material 26 is excited by an ultraviolet ray generated during the plasma discharge to generate any one of red, green and blue visible light rays. An inactive mixture gas for a gas discharge is injected into a discharge space defined between the upper and lower substrate 10 and 18 and the barrier rib 24.

Such a PDP makes a time-divisional driving of one frame, which is divided into various sub-fields having a different emission frequency, so as to realize gray levels of a picture. Each sub-field is again divided into an initialization period for initializing the entire field, an address period for selecting a scan line and selecting the cell from the selected scan line and a sustain period for expressing gray levels depending on the discharge frequency. Herein, the initialization period is again divided into a set-up interval supplied with a rising ramp waveform and a set-down interval supplied with a falling ramp waveform.

For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-field SF1 to SF8 is divided into an initialization period, an address period and a sustain period as mentioned above. Herein, the initialization period and the address period of each sub-field are equal for each sub-field, whereas the sustain period and the number of sustain pulses assigned thereto are increased at a ratio of $2^n$ (wherein n=0, 1, 2, 3, 4, 5, 6 and 7) at each sub-field.

FIG. 3 shows a driving waveform of the PDP applied to two sub-fields.

In FIG. 3, Y represents the scan electrode; Z does the sustain electrode; and X does the address electrode.

Referring to FIG. 3, the PDP is divided into an initialization period for initializing the full field, an address period for selecting a cell, and a sustain period for sustaining a discharge of the selected cell for its driving.

In the initialization period, a rising ramp waveform Ramp-up is simultaneously applied to all the scan electrodes Y1 to Yn in a set-up interval. This rising ramp waveform Ramp-up causes a weak discharge within cells at the full field to generate wall charges within the cells. The rising ramp waveform Ramp-up rises from a sustain voltage Vs until a sum voltage of a set-up voltage Vsetup with the sustain voltage Vs.

In a set-down interval, after the rising ramp waveform Ramp-up was supplied, a falling ramp waveform Ramp-down falling from a positive voltage Vs lower than a peak voltage of the rising ramp waveform Ramp-up is simultaneously applied to the scan electrodes Y. The falling ramp waveform Ramp-down causes a weak erasure discharge within the cells, to thereby erase spurious charges of wall charges and space charges generated by the set-up discharge and uniformly leave wall charges required for the address discharge within the cells of the full field. In real, the falling ramp waveform Ramp-down falls from the sustain voltage until a negative voltage −Vy such that desired wall charges can be left during the set-down interval.

In the address period, a negative scanning pulse is sequentially applied to the scan electrodes Y and, at the same time, a positive data pulse data is applied to the address electrodes X. A voltage difference between the scanning pulse scan and the data pulse data is added to a wall voltage generated in the initialization period, to thereby generate an address discharge within the cells supplied with the data pulse data. Wall charges are formed within the cells selected by the address discharge.

Meanwhile, a positive direct current voltage having a sustain voltage level Vs is applied to the sustain electrodes Z during the set-down interval and the address period.

In the sustain period, a sustaining pulse sus is alternately applied to the scan electrodes Y and the sustain electrodes Z. Then, a wall voltage within the cell selected by the address discharge is added to the sustain pulse sus to thereby generate a sustain discharge taking a surface-discharge type between the scan electrodes Y and the sustain electrode Z whenever each sustain pulse sus is applied. Finally, after the sustain discharge was finished, an erasing ramp waveform erase having a small pulse width is applied to the sustain electrode Z to thereby erase wall charges left within the cells.

In such a set-up interval of the conventional PDP, the scan electrode is supplied with a positive voltage while the sustain electrode Z is supplied with a negative voltage (or ground voltage). Thus, in the set-up interval, negative wall charges are formed at the scan electrode Y while positive wall charges are formed at the sustain electrode Z as shown in FIG. 4. In the set-down interval, a falling ramp waveform Ramp-down falling from a positive voltage lower than a peak voltage of the rising ramp waveform Ramp-up is supplied. Thus, spurious wall charges formed excessively and non-uniformly are erased to reduce wall charges within the cell into a certain amount.

Subsequently, in the address period, the scan electrode Y is supplied with a negative voltage while the sustain electrode Z is supplied with a positive voltage. At this time, a voltage value (negative value) of wall charges formed in the set-down interval is summed with a negative voltage value applied to the scan electrode Y to thereby generate an address discharge.

The conventional PDP driven in this manner generates a stable address discharge only when desired wall charges are formed in the initialization period. However, since the prior art may not produce desired wall charges in the initialization period depending upon a characteristic of the panel, it generates a brightness miss-fire or a miss-writing phenomenon.

More specifically, when wall charges are normally formed in the initialization period, negative wall charges are formed at the scan electrode Y while positive wall charges are formed at the scan electrode Z as shown in FIG. 4. However, a portion of discharge cells forms positive all charges at the scan electrode Y during the set-down interval as shown in FIG. 5 due to a problem such as a panel characteristic, etc. In other words, during the set-down interval, the falling ramp waveform Ramp-down falls until a negative voltage −Vy. At this time, positive wall charges are formed at the scan electrode Y of the portion of discharge cells. If positive wall charges are formed at the scan electrode Y as mentioned above, then a brightness spot miss-fire or a miss-writing phenomenon occurs to cause a deterioration of picture quality in the PDP.

DISCLOSURE OF INVENTION

Accordingly, it is an object of the present invention to provide an apparatus and method for driving a plasma display panel that is adaptive for preventing a brightness spot miss-fire and a miss-writing as well as reducing a manufacturing cost.

In order to achieve these and other objects of the invention, a driving apparatus for a plasma display panel according to one aspect of the present invention includes a set-up supplier for supplying a rising ramp waveform to scan electrodes in an initialization period and for supplying a positive enhancing pulse to the scan electrodes during an enhancing period following said initialization period; and a negative voltage supplier for supplying a falling ramp waveform to the scan electrodes in the initialization period and for supplying a negative enhancing pulse to the scan electrodes during the enhancing period.

In the driving apparatus, the negative voltage supplier includes only a single of switching device.

The negative voltage supplier includes a switching device provided between one terminal of a drive integrated circuit and a scan voltage source; and a variable resistor connected to a gate terminal of the switching device to limit a channel width of the switching device.

Said negative enhancing pulse falls until a voltage higher than a voltage value of said falling ramp waveform.

The switching device keeps a turn-on state from a period at which said negative enhancing pulse is supplied until an address period.

In a method of driving a plasma display panel, in which one frame has a plurality of sub-fields, according to another aspect of the present invention, any at least one of sub-fields included in said frame is comprised of an initialization period for forming wall charges at all of discharge cells; a first enhancing period for supplying a positive enhancing pulse to a scan electrode such that desired wall charges can be formed at all the discharge cells; a second enhancing period for supplying a negative enhancing pulse after said positive enhancing pulse was supplied; an address period for causing an address discharge so as to select said discharge cell; and a sustain period for causing a predetermined frequency of sustain discharge according to a gray level value at the discharge cells at which said address discharge occurs.

In the method, said initialization period is divided into a set-up interval and a set-down interval, and a rising ramp waveform rising at a slope from a sustain voltage until a sum voltage of said sustain voltage with a set-up voltage is supplied in the set-up period while a falling ramp waveform falling at a slope from said sustain voltage until a negative voltage in the set-down period.

Herein, said negative enhancing pulse falls until a voltage higher than said negative voltage at a slope.

As described above, according to the present invention, a positive enhancing pulse is supplied after the reset period to prevent an inversion phenomenon of wall charges. Furthermore, a negative enhancing pulse is supplied after the positive enhancing pulse, thereby reducing the number of switches included in the scan electrode driver and thus reducing the manufacturing cost.

BRIEF DESCRIPTION OF DRAWINGS

These and other objects of the invention will be apparent from the following detailed description of the embodiments of the present invention with reference to the accompanying drawings, in which.

BEST MODE FOR CARRYING OUT THE INVENTION

Reference will now be made in detail to the preferred embodiments of the present invention, examples of which are illustrated in the accompanying drawings.

Hereinafter, the preferred embodiments of the present invention will be described in detail with reference to FIGS. 6 to 9.

Figure 6:
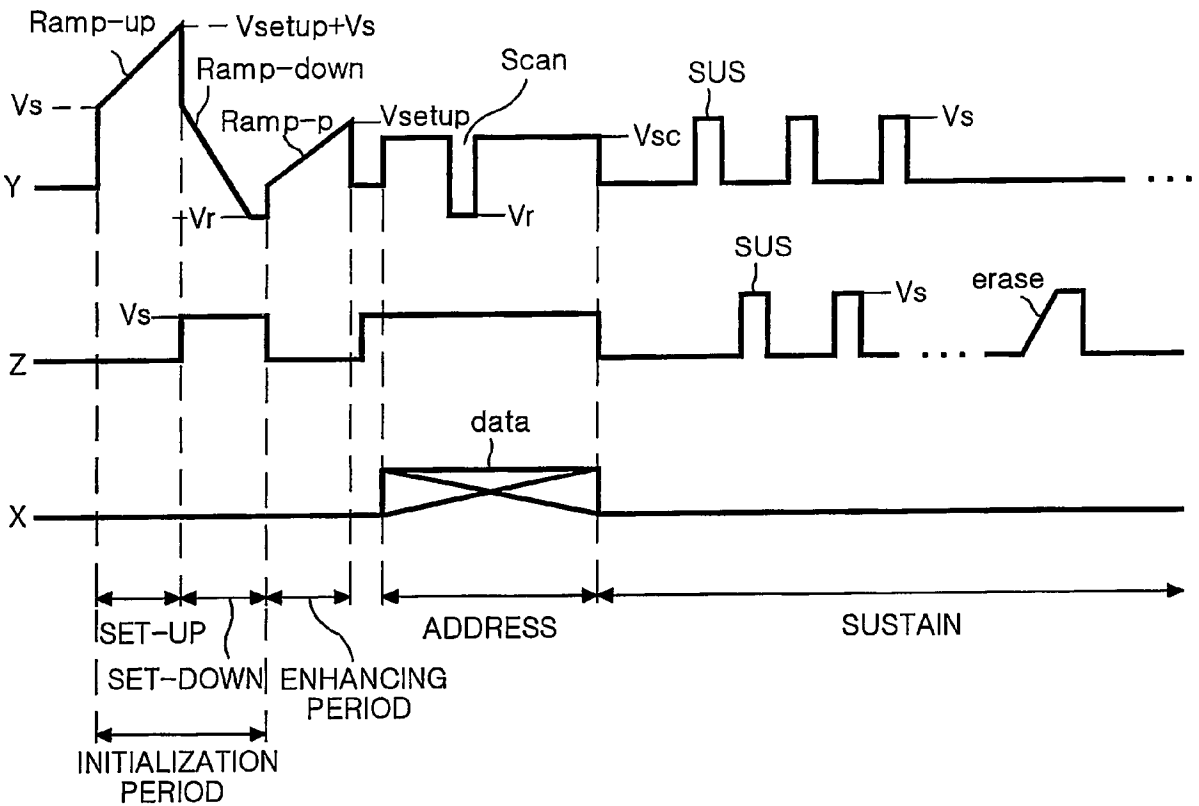
FIG. 6 is a waveform diagram for explaining a method of driving a plasma display panel according to a first embodiment of the present invention.

FIG. 6 is a waveform diagram for explaining a method of driving a plasma display panel according to a first embodiment of the present invention.

Referring to FIG. 6, the PDP according to the first embodiment of the present invention is divided into an initialization period for initializing the full field, an enhancing period for preventing an inversion of wall charges, an address period for selecting a cell, and a sustain period for sustaining a discharge of the selected cell for its driving.

In the initialization period, a rising ramp waveform Ramp-up is simultaneously applied to all the scan electrodes Y1 to Yn in a set-up interval. This rising ramp waveform Ramp-up causes a weak discharge within cells at the full field to generate wall charges within the cells. The rising ramp waveform Ramp-up rises from a sustain voltage Vs until a sum voltage of a set-up voltage Vsetup with the sustain voltage Vs.

In a set-down interval, after the rising ramp waveform Ramp-up was supplied, a falling ramp waveform Ramp-down falling from a positive voltage Vs lower than a peak voltage of the rising ramp waveform Ramp-up is simultaneously applied to the scan electrodes Y. The falling ramp waveform Ramp-down causes a weak erasure discharge within the cells, to thereby erase spurious charges of wall charges and space charges generated by the set-up discharge and uniformly leave wall charges required for the address discharge within the cells of the full field. In real, the falling ramp waveform Ramp-down falls from the sustain voltage until a negative voltage −Vy such that desired wall charges can be left during the set-down interval.

Figure 1:
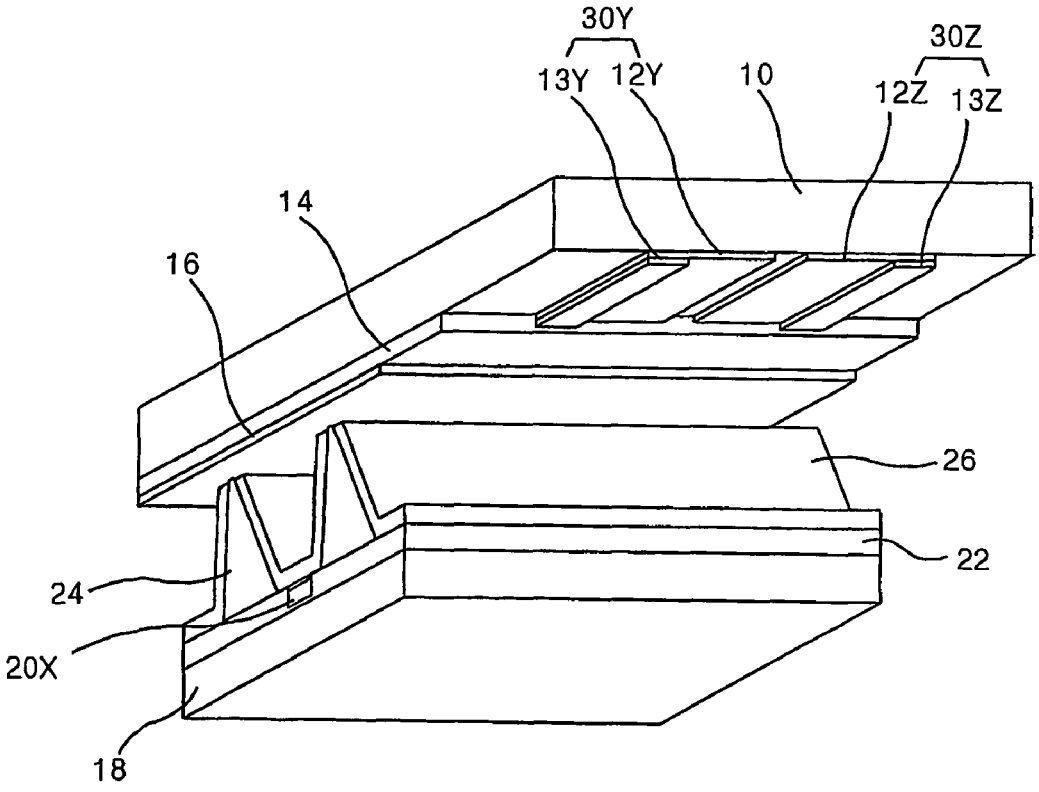
FIG. 1 RELATED ART
FIG. 1 is a perspective view showing a discharge cell structure of a conventional three-electrode, AC surface-discharge plasma display panel.
Figure 2:
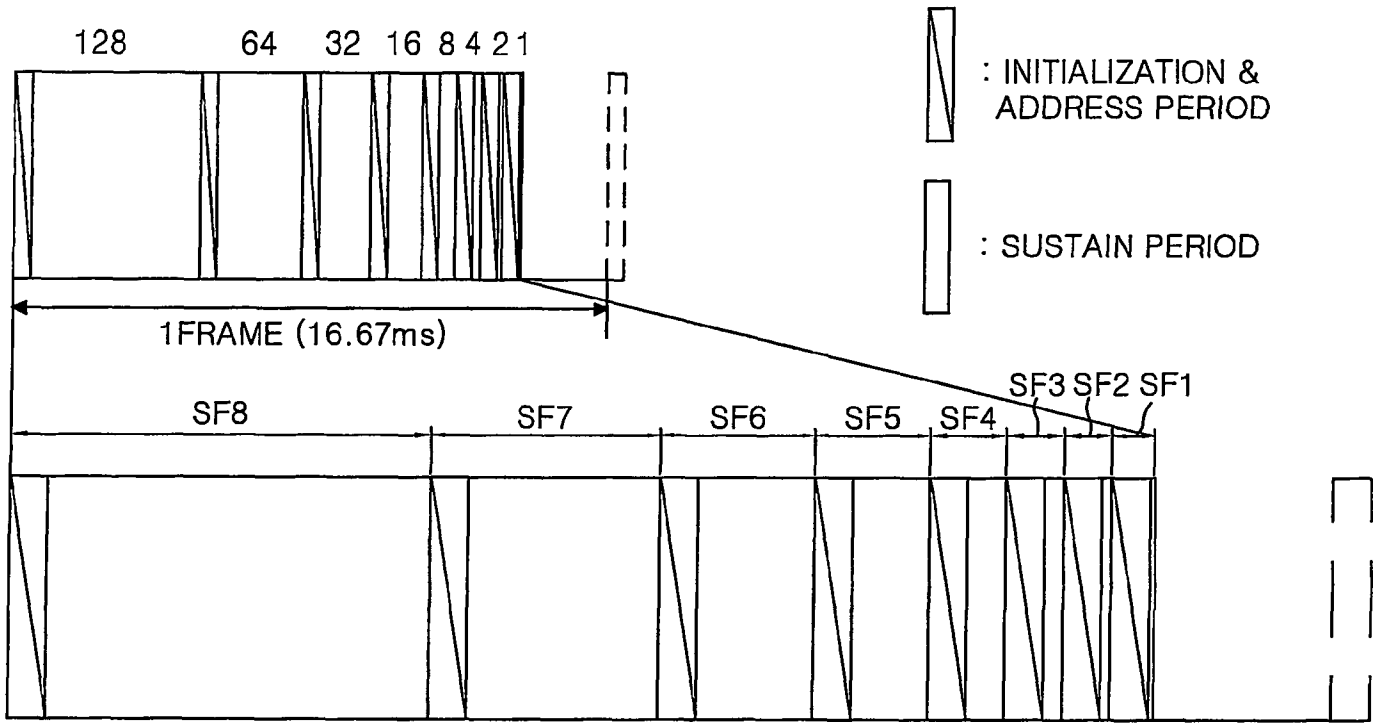
FIG.2 RELATED ART
FIG. 2 illustrates sub-fields included in one frame of the conventional plasma display panel.
Figure 3:
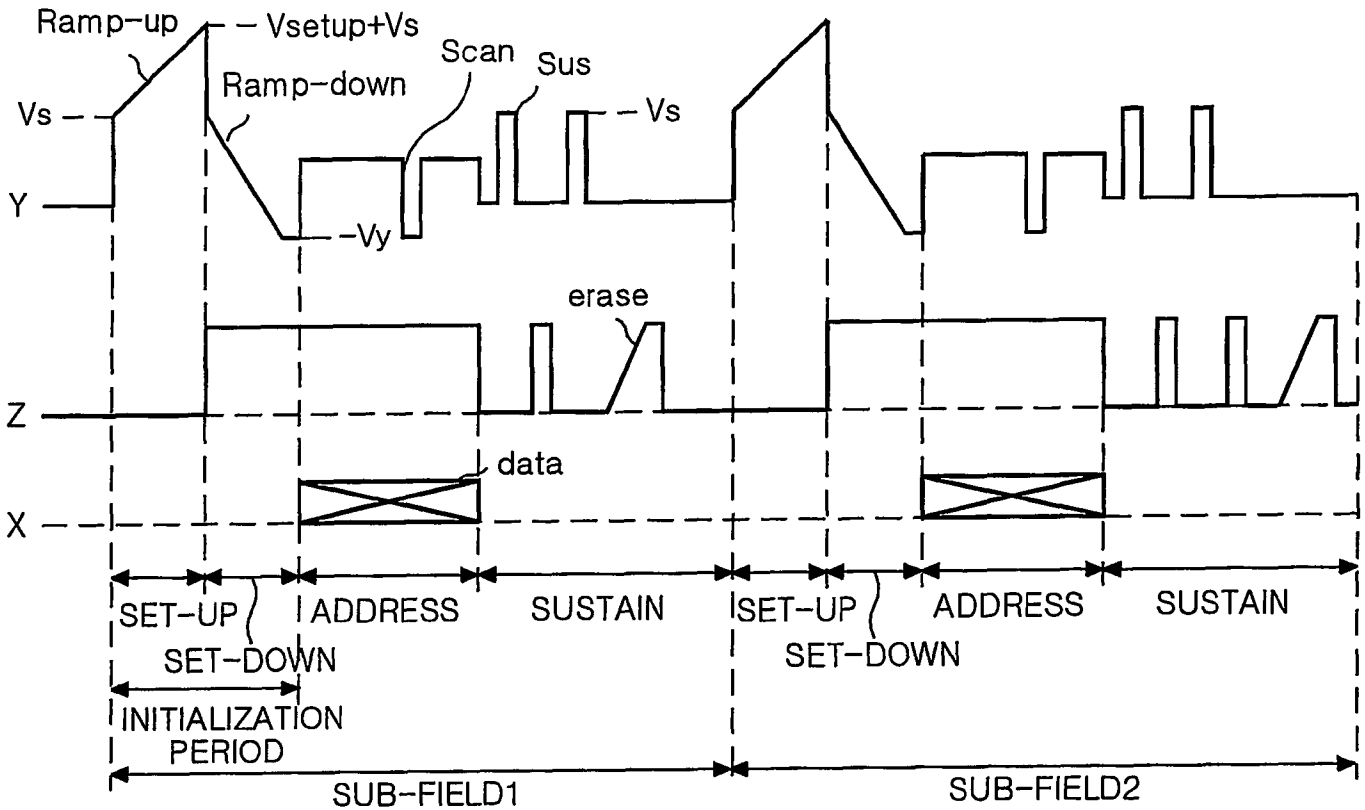
FIG. 3 RELATED ART
FIG. 3 is a waveform diagram of driving signals supplied to the electrodes during the sub-fields shown in FIG. 2.
Figure 4:
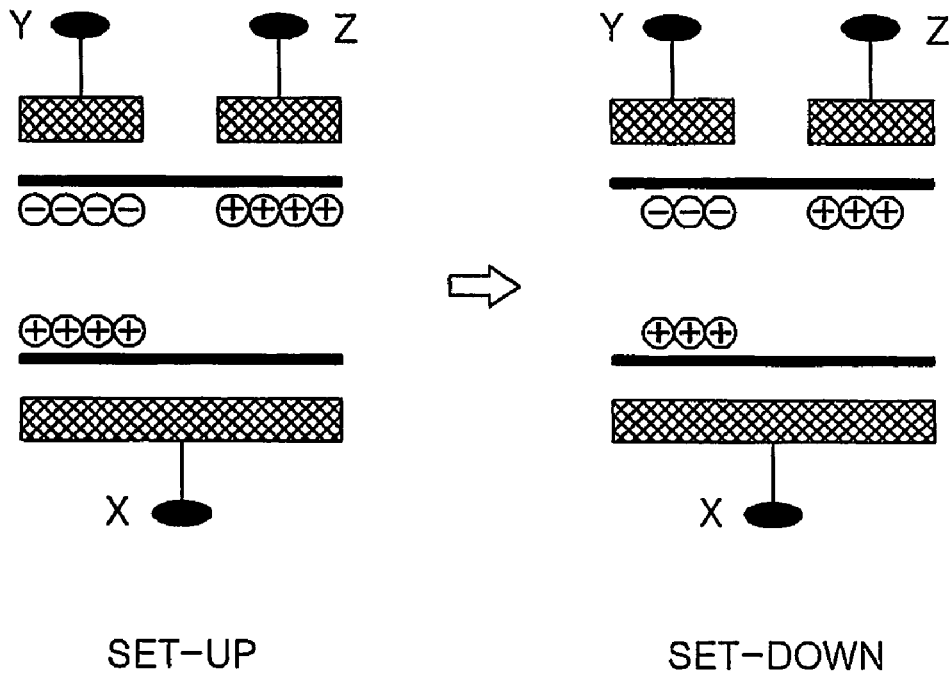
FIG. 4 illustrates wall charges formed at the electrodes during the initialization period shown in FIG. 2.
Figure 5:
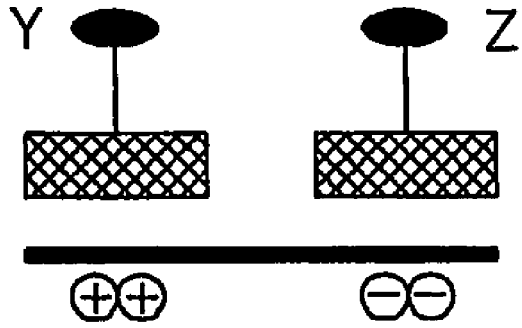
FIG. 5 illustrates wall charges formed at a portion of discharge cells during the initialization period shown in FIG. 2.

In the enhancing period, a positive enhancing pulse Ramp-p rising from a ground voltage GND until a set-up voltage Vsetup is supplied. The enhancing pulse Ramp-p causes a fine discharge such that desired wall charges can be formed at the discharge cells. More specifically, negative wall charges are formed at the scan electrodes Y included in a majority of discharge cells while positive wall charges are formed at the sustain electrode Z during the set-down period. However, positive wall charges are formed at the scan electrodes Y included in a portion of discharge cells as shown in FIG. 5. Thus, the enhancing pulse Ramp-p is applied during the enhancing period to thereby form negative wall charges at all the scan electrodes Y. In other words, the scan electrodes Y at which positive wall charges have been formed during the set-down period also pass through the enhancing period to thereby form negative wall charges.

In the address period, a negative scanning pulse is sequentially applied to the scan electrodes Y and, at the same time, a positive data pulse data is applied to the address electrodes X. A voltage difference between the scanning pulse scan and the data pulse data is added to a wall voltage generated in the initialization period, to thereby generate an address discharge within the cells supplied with the data pulse data. Wall charges are formed within the cells selected by the address discharge. Meanwhile, the first embodiment of the present invention forms negative wall charges at the scan electrodes Y provided at all the discharge cells during the enhancing period, so that it can generates a stable address discharge. Accordingly, it becomes possible to prevent a miss-writing and/or a brightness spot miss-fire phenomenon.

Meanwhile, a positive direct current voltage having a sustain voltage level Vs is applied to the sustain electrodes Z during the set-down interval and the address period. Further, a ground voltage GND is applied to the sustain electrodes Z during the enhancing period. As the ground voltage GND is supplied to the sustain electrodes Z, a stable enhancing discharge can be generated.

In the sustain period, a sustaining pulse sus is alternately applied to the scan electrodes Y and the sustain electrodes Z. Then, a wall voltage within the cell selected by the address discharge is added to the sustain pulse sus to thereby generate a sustain discharge taking a surface-discharge type between the scan electrodes Y and the sustain electrode Z whenever each sustain pulse sus is applied. Finally, after the sustain discharge was finished, an erasing ramp waveform erase having a small pulse width is applied to the sustain electrode Z to thereby erase wall charges left within the cells.

Figure 7:
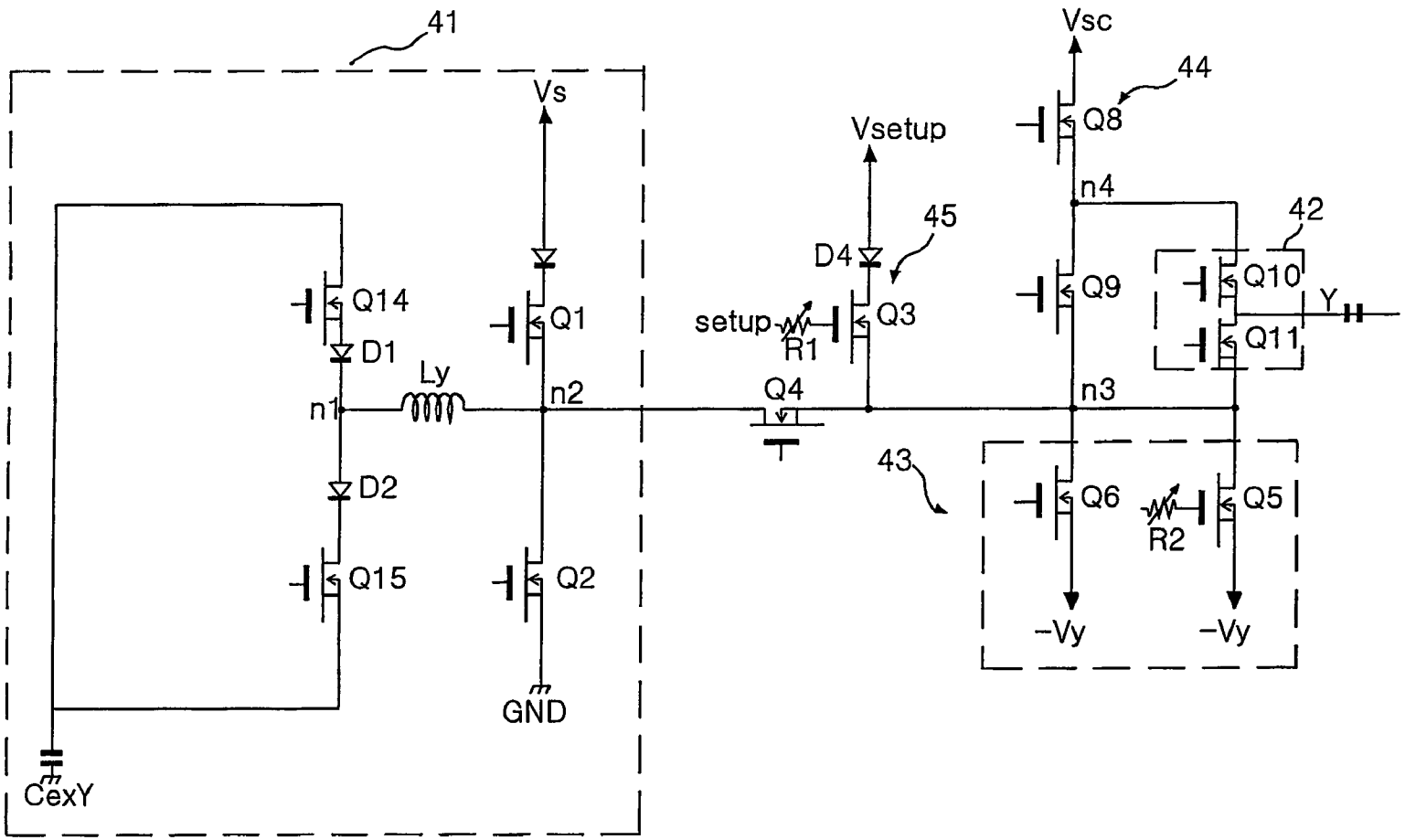
FIG. 7 is a circuit diagram of the scan electrode driver according to the first embodiment of the present invention.

FIG. 7 schematically shows the scan electrode driver according to the first embodiment of the present invention.

Referring to FIG. 7, the scan electrode driver includes an energy recovery circuit 41, a fourth switch Q4 connected between the energy recovery circuit 41 and a drive integrated circuit (IC) 42, a negative voltage supplier 43 and a scan reference voltage supplier 44 connected between the fourth switch Q4 and the drive IC 42, and a set-up supplier 45 connected among the fourth switch Q4, the negative voltage supplier 43 and the scan reference voltage supplier 44.

The drive IC 42 is connected in a push-pull type, and includes tenth and eleventh switches Q10 and Q11 for receiving voltage signals from the energy recovery circuit 41, the negative voltage suppler 43, the set-up supplier 45 and the scan reference voltage supplier 44. An output line between the tenth and eleventh switches Q10 and Q11 is connected to any one of the scan electrode lines Y.

The energy recovery circuit 41 includes an external capacitor CexY for charging energy recovered from the scan electrode lines Y, switches Q14 and Q15 connected, in parallel, to the external capacitor CexY, an inductor Ly connected between a first node n1 and a second node n2, a first switch Q1 connected between a sustain voltage source Vs and the second node n2, and a second switch Q2 connected between the second node n2 and a ground voltage terminal GND.

An operation of the energy recovery circuit 41 will be described below.

Firstly, it is assumed that a Vs/2 voltage has been charged in the external capacitor CexY. If a fourteenth switch Q14 is turned on, then the voltage charged in the external capacitor CexY is supplied, via the fourteenth switch Q14, a first diode D1, the inductor Ly and the fourth switch Q4, to the drive IC 42, and is supplied, via an internal diode (not shown) of the drive IC 42, to the scan electrode line Y. At this time, since the inductor Ly configures a serial LC resonance circuit along with a capacitor C equivalently formed at the discharge cell, a voltage of about Vs is supplied to the scan electrode lines Y.

Thereafter, the first switch Q1 is turned on. As the first switch Q1 is turned on, the sustain voltage Vs is supplied, via the first switch Q1 and the drive IC 42, to the scan electrode lines Y. After a desired time, the first switch Q1 is turned off while a fifteenth switch Q15 is turned on. At this time, energy charged in the capacitor C of the discharge cell is applied, via the drive IC 42, the fourth switch Q4, the second diode D2 and the fifth switch Q15, to the external capacitor CexY. In other words, energy is recovered from the PDP into the external capacitor CexY. Then, if the fifteenth switch Q15 is turned off and the second switch Q2 is turned on, a voltage at the scan electrode line Y maintains a ground voltage GND. The energy recovery circuit 41 recovers an energy from the PDP and then again supplies the recovered energy to the PDP, thereby reducing an excessive power consumption during a discharge in the set-up interval and the sustain period.

The set-up supplier 45 includes a fourth diode D4 and a third switch Q3 connected between a set-up voltage source Vsetup and a third node n3. The fourth diode D4 shuts off a backward current flowing from the third node n3 into the set-up voltage source Vsetup. The set-up supplier 45 further includes a capacitor (not shown) for adding a Vs voltage supplied from the energy recovery circuit 41 to a Vsetup voltage. Also, a first variable resistor R1 is connected to the previous stage of the third switch Q3. The first variable resistor R1 limits a channel width of the third switch Q3 in such a manner to open it slowly, thereby applying a rising ramp waveform Ramp-up having a predetermined slope.

During the set-up interval, a Vs voltage is supplied from the energy recovery circuit 41 to the scan electrode lines Y. At this time, the scan electrode lines Y suddenly rise into the Vs voltage. Then, the third switch Q3 is switched in response to a control signal setup from a timing controller (not shown) to thereby apply a rising ramp waveform Ramp-up having a predetermined slope to the third node n3 (or the scan electrode lines Y). In real, during the set-up interval, a rising ramp waveform Ramp-up having a summed voltage value Vs+Vsetup at the capacitor (not shown) is supplied to the third node n3.

Further, the set-up supplier 45 supplies an enhancing pulse Ramp-p (having the same slope as the rising ramp waveform), via the third node n3, to the drive IC 42 during the enhancing period. Herein, the enhancing pulse Ramp-p rises until the Vsetup voltage. The enhancing pulse Ramp-p supplied to the third node n3 is applied, via the drive IC 42, to the scan electrodes Y. At this time, an enhancing discharge is generated at the discharge cells. Thus, negative wall charges are formed at the scan electrode Y.

The scan reference voltage supplier 44 includes an eighth switch Q8 connected between a scan reference voltage source Vsc and the fourth node n4. The eighth switch Q8 supplies a scan reference voltage Vsc to the fourth node n4 during the address period.

The negative voltage supplier 43 includes a fifth switch Q5 and a sixth switch Q6 connected, in parallel, between the third node n3 and the scan voltage source −Vy. The fifth switch Q5 applies a falling ramp waveform Ramp-down to the third node n3 during the set-down period. To this end, a second variable resistor R2 is connected to the gate terminal of the fifth switch Q5. The second variable resistor R2 limits a channel width of the fifth switch Q5 in such a manner to open it slowly, thereby supplying a falling ramp waveform Ramp-down having a predetermined slope. The sixth switch Q6 applies a scanning pulse scan to the third node n3 during the address period.

In this case, the fifth and sixth switches Q5 and Q6 included in the negative voltage supplier 43 supply the same voltage, that is, a scan voltage −Vy to the third node n3. Herein, since the fifth switch Q5 is used in the set-down interval while the sixth switch Q6 is used in the address period, the negative voltage supplier 43 in the first embodiment of the present invention includes two switches Q5 and Q6 to thereby cause a problem in that a manufacturing cost rises.

Figure 8:
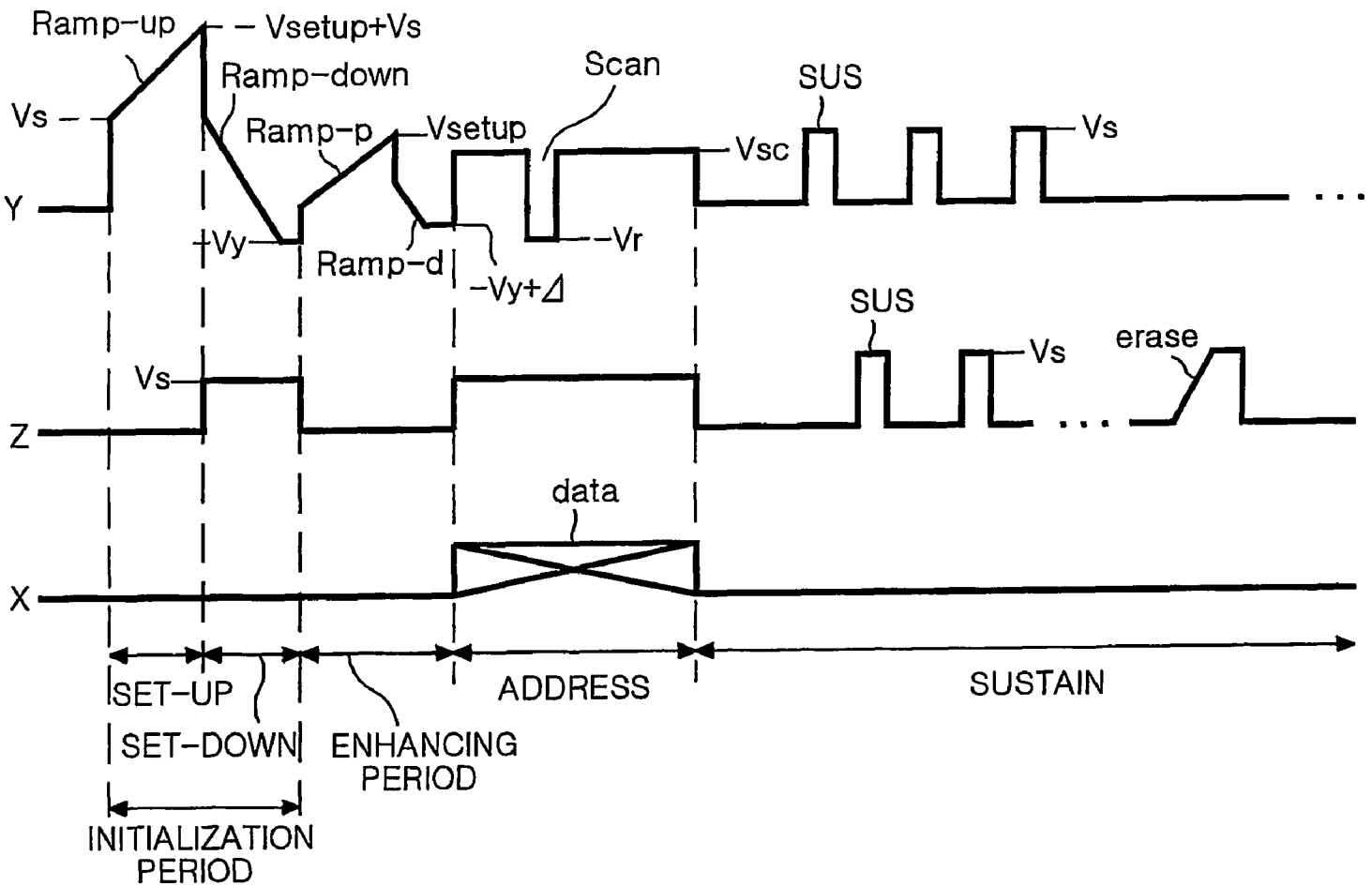
FIG. 8 is a waveform diagram for explaining a method of driving a plasma display panel according to a second embodiment of the present invention.
Figure 9:
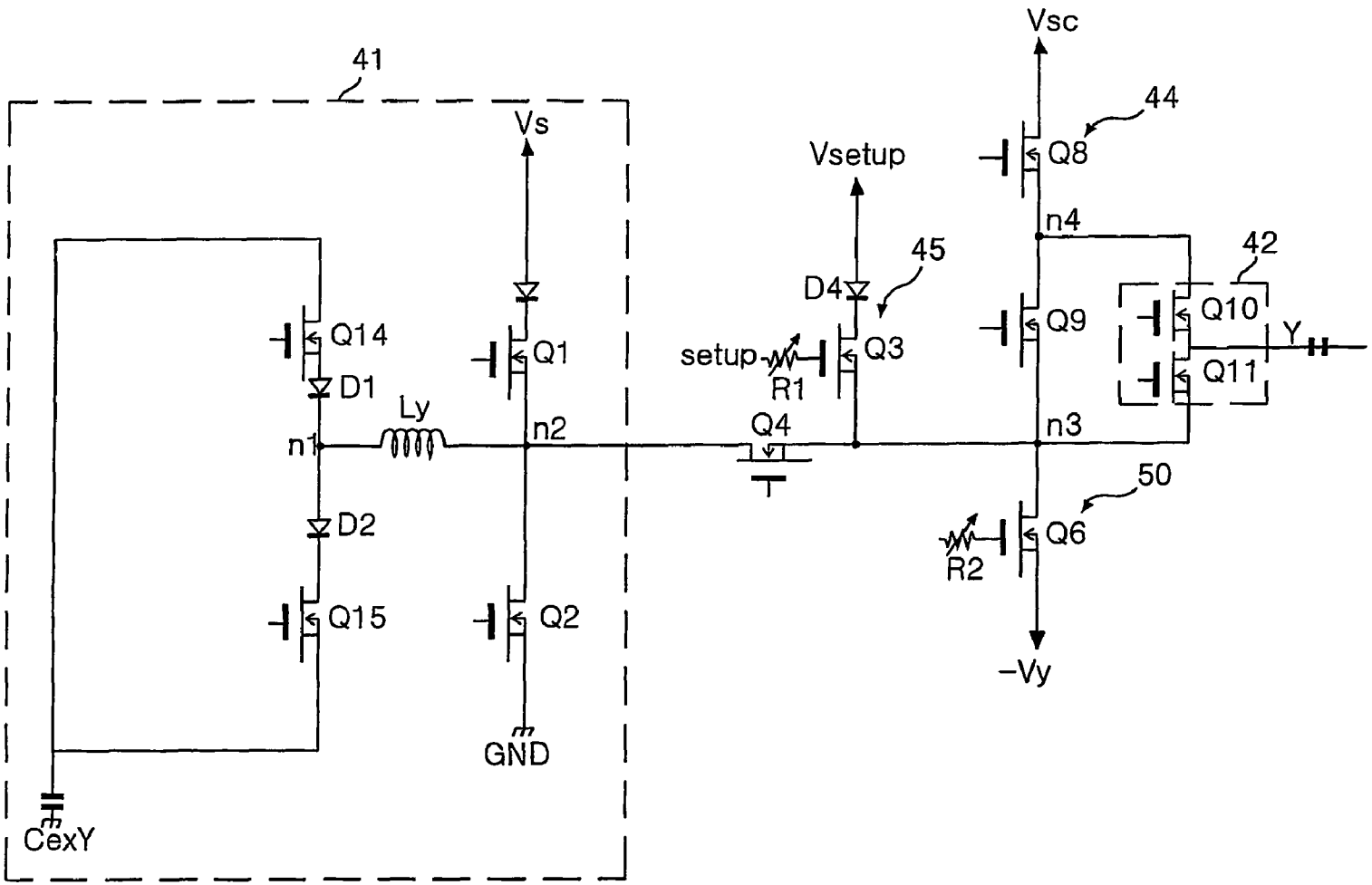
FIG. 9 is a circuit diagram of the scan electrode river according to the second embodiment of the present invention.

In order to overcome this problem, there are suggested a driving method and a scan electrode driver according to a second embodiment of the present invention as shown in FIG. 8 and FIG. 9. For the sake of explaining FIG. 8 and FIG. 9, waveforms (or elements) having the same function as FIG. 6 and FIG. 9 will be assigned to the same reference numerals and thus a detailed explanation as to them will be omitted.

FIG. 8 is a waveform diagram for explaining a method of driving a plasma display panel according to a second embodiment of the present invention.

Referring to FIG. 8, the PDP according to the second embodiment of the present invention is divided into an initialization period for initializing the full field, an enhancing period for preventing an inversion of wall charges, an address period for selecting a cell, and a sustain period for sustaining a discharge of the selected cell for its driving.

In the initialization period, a rising ramp waveform Ramp-up is simultaneously applied to all the scan electrodes Y1 to Yn in a set-up interval. This rising ramp waveform Ramp-up causes a weak discharge within cells at the full field to generate wall charges within the cells. The rising ramp waveform Ramp-up rises from a sustain voltage Vs until a sum voltage of a set-up voltage Vsetup with the sustain voltage Vs.

In a set-down interval, after the rising ramp waveform Ramp-up was supplied, a falling ramp waveform Ramp-down is applied to all the scan electrodes Y. This falling ramp waveform Ramp-down causes a fine discharge within the cells to uniformly leave wall charges within the cells. The falling ramp waveform Ramp-down falls from the sustain voltage Vs until a negative scan voltage −Vy.

In the enhancing period, a positive enhancing pulse Ramp-p rising from a ground voltage GND until a set-up voltage Vsetup is supplied. The enhancing pulse Ramp-p causes a fine discharge such that desired wall charges can be formed at the discharge cells. Thereafter, a negative enhancing pulse Ramp-d falling from the ground voltage GND until a voltage −Vy+Δ is supplied in the enhancing period. The negative enhancing pulse Ramp-d falls until a voltage higher than a voltage value of the scan voltage source −Vy such that wall charges generated by the positive enhancing pulse Ramp-p are not erased. Herein, the negative enhancing pulse Ramp-d is supplied, so that a voltage value of the scan electrode line Y can be fallen until a voltage value similar to the voltage value of the scan voltage source −Vy prior to the address period.

In the address period, a negative scanning pulse is sequentially applied to the scan electrodes Y and, at the same time, a positive data pulse data is applied to the address electrodes X to thereby select the discharge cell.

Meanwhile, a positive direct current voltage having a sustain voltage level Vs is applied to the sustain electrodes Z during the set-down interval and the address period.

In the sustain period, a sustaining pulse sus is alternately applied to the scan electrodes Y and the sustain electrodes Z, thereby generating a sustain discharge at the discharge cells selected in the address period. Finally, after the sustain discharge was finished, an erasing ramp waveform erase having a small pulse width is applied to the sustain electrode Z to thereby erase wall charges left within the cells.

FIG. 9 schematically shows the scan electrode driver according to the second embodiment of the present invention.

Referring to FIG. 9, the scan electrode driver includes an energy recovery circuit 41, a fourth switch Q4 connected between the energy recovery circuit 41 and a drive integrated circuit (IC) 42, a negative voltage supplier 50 and a scan reference voltage supplier 44 connected between the fourth switch Q4 and the drive IC 42, and a set-up supplier 45 connected among the fourth switch Q4, the negative voltage supplier 50 and the scan reference voltage supplier 44.

The drive IC 42 is connected in a push-pull type, and selectively supplies a voltage applied thereto to the scan electrodes Z. In other words, the drive IC 42 selectively supplies any one of voltages applied to tenth and eleventh switches Q10 and Q11 to the scan electrodes Y. To this end, a ninth switch Q9 is provided in parallel to the drive IC 42. The ninth switch Q9 electrically disconnects both terminals of the drive IC 42 from each other selectively.

The energy recovery circuit 41 applies a sustaining pulse sus with a sustain voltage value to the drive IC 42 during the sustain period. Further, the energy recovery circuit 41 supplies a Vs voltage to a third node n3 during the set-up period.

The set-up supplier 45 applies a rising ramp waveform Ramp-up having a predetermined slope and a voltage value Vs+Vsetup to the drive IC 42 during the set-up interval. Further, the set-up supplier 45 applies a positive enhancing pulse Ramp-p having the same slope as the rising ramp waveform Ramp-up to the drive IC 42 during the enhancing period. Herein, the enhancing pulse Ramp-p raises a voltage value Vsetup.

The scan reference voltage supplier 44 includes an eighth switch Q8 connected between a scan reference voltage source Vsc and the fourth node n4. The eighth switch Q8 supplies a scan reference voltage Vsc to the fourth node n4 (or the tenth switch Q10) during the address period. Herein, the ninth switch Q9 keeps a turn-off state during the address period.

The negative voltage supplier 50 includes a single of switch, that is, a sixth switch Q6 between the third node n3 and the scan voltage source −Vy. A second variable resistor R2 for limiting a channel width of the sixth switch Q5 such that a scan voltage −Vy supplied to the third node n3 can be fallen at a predetermined slope is connected to the gate terminal of the sixth switch Q6. During the set-down period, the sixth switch Q6 is turned on to thereby apply a falling ramp waveform Ramp-down to the third node n3. The falling ramp waveform Ramp-down supplied to the third node n3 is applied to the scan electrodes Y by the drive IC 42.

Further, the negative voltage supplier 50 applies a negative enhancing pulse Ramp-d to the third node n3 during the enhancing period. More specifically, after a positive enhancing pulse Ramp-p was supplied to the scan electrodes Y, the sixth switch Q6 is turned on. As the sixth switch Q6 is turned on, the third node n3 slowly falls from the ground voltage GND at a predetermined slope. At this time, the drive IC 42 supplies a voltage applied to the third node n3 to the scan electrodes Y. In other words, a negative enhancing pulse Ramp-d is applied to the scan electrodes Y. Herein, the eleventh switch Q11 of the drive IC 42 is turned off before a voltage value at the third node n3 falls into −Vy. Thus, the negative enhancing pulse Ramp-d supplied to the scan electrodes Y does not falls into a voltage −Vy.

Meanwhile, after the negative enhancing pulse was supplied, the sixth switch Q6 keeps a turn-on state during the address period. Thus, a voltage value at the third node n3 has a scan voltage value −Vy. During the address period, the drive IC 42 supplies any one of voltages applied to the third and fourth nodes n3 and n4 to the scan electrodes Y. In other words, a voltage applied to the third node n3 is supplied to the scan electrode Y when a scanning pulse is applied to the scan electrode Y, whereas a voltage applied to the fourth node n4 is supplied to the scan electrode Y.

In the second embodiment of the present invention, a voltage value supplied one terminal of the drive IC 42 prior to the address period is fallen into a voltage similar to the scan voltage −Vy, so that a single of switch Q6 only is included in the negative voltage supplier 50. Accordingly, the second embodiment of the present invention can reduce a manufacturing cost.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

The invention claimed is:

1. A plasma display device comprising:

a plasma display panel (PDP) having scan electrodes and sustain electrodes to form a plurality of electrode pairs; and a first driving circuit configured to successively apply a first signal and a second signal to the scan electrodes before an address period of at least one sub-field, wherein the first signal comprises an initialing pulse rising to a first maximum voltage value and a first decreasing pulse falling to a first minimum voltage value, the second signal comprises an enhancing pulse rising to a second maximum voltage value that is less than the first maximum voltage value and a second decreasing pulse falling to a second minimum voltage value that is greater than the first minimum voltage value, and the second maximum voltage value is equal to a sustain voltage applied to the scan electrodes or applied to the sustain electrodes in a sustain period of the at least one sub-field.

2. The plasma display device as set forth in claim 1, wherein a difference between the first maximum voltage value and the second maximum voltage value is substantially the same as a sustain voltage applied to the scan electrodes or the sustain electrodes in a sustain period of the at least one sub-field.

3. The plasma display device as set forth in claim 1, wherein a slope of the initialing pulse is substantially the same as a slope of the enhancing pulse.

4. The plasma display device as set forth in claim 1, wherein a ground voltage is applied to the sustain electrodes when the second signal is applied to the scan electrodes.

5. The plasma display device as set forth in claim 4, wherein the sustain voltage provided to the scan electrodes or to the sustain electrodes during a sustain period is provided to the sustain electrodes when the first decreasing pulse is applied to the scan electrodes.

6. The plasma display device as set forth in claim 1, wherein the second decreasing pulse directly falls from the second maximum voltage value to the second minimum voltage value.

7. The plasma display device as set forth in claim 1, wherein the first minimum voltage value is lower than a ground voltage and is higher than a voltage value of a negative scanning pulse applied to the scan electrodes in the address period of the at least one sub-field.

8. A method of driving a plasma display panel based on a plurality of sub-fields, the plasma display panel having a plurality of discharge cells, and each of the cells having a scan electrode and a sustain electrode, the method comprising:

providing a first signal including an initialing pulse followed by a first decreasing pulse to the scan electrode during an initialization period of at least one sub-field;

providing successively a second signal including an enhancing pulse followed by a second decreasing pulse to the scan electrode after providing the first signal, wherein a lowest voltage of the first decreasing pulse is less than a lowest voltage of the second decreasing pulse;

providing a scan signal to the scan electrode during an address period of the at least one sub-field, the scan signal being provided after the second signal in the at least one sub-field;

providing at least one sustain signal to at least one of the scan electrode or the sustain electrode during a sustain period of the at least one sub-field, wherein the initialing pulse of the first signal has a first peak voltage value, and the enhancing pulse of the second signal has a second peak voltage value, and wherein the first peak voltage value is greater than the second peak voltage value, and wherein the second peak voltage value is equal to a voltage value of the sustain signal.

9. The method of claim 8, wherein a sustain voltage is provided to the sustain electrode when the first decreasing pulse is provided to the scan electrode.

10. The method of claim 9, wherein a ground voltage is provided to the sustain electrode when the second signal is provided to the scan electrode.

11. The method of claim 8, wherein the lowest voltage of a second decreasing pulse is lower than a ground voltage and is higher than a voltage value of the scan signal.

* * * * *